US005725176A

United States Patent [19]

Vigneau

[11] Patent Number: 5,725,176

[45] Date of Patent: Mar. 10, 1998

[54] METHOD AND APPARATUS FOR CONVOLUTE WINDING

[75] Inventor: Richard J. Vigneau, Green Bay, Wis.

[73] Assignee: Paper Converting Machine Co., Green Bay, Wis.

[21] Appl. No.: 589,049

[22] Filed: Jan. 19, 1996

[51] Int. Cl.[6] ..... B65H 35/10

[52] U.S. Cl. ..... 242/521; 242/527.3; 242/532.3; 242/533.4

[58] Field of Search ..... 242/527.3, 527.4, 242/733.4, 733.5, 733.6, 732.3, 521

[56] References Cited

U.S. PATENT DOCUMENTS

| | | | |
|---|---|---|---|
| Re. 28,353 | 3/1975 | Nystrand et al. . | |
| 2,318,056 | 5/1943 | Christman | 242/533.4 X |
| 2,512,900 | 6/1950 | Kwitek . | |
| 2,769,600 | 11/1956 | Kwitek et al. . | |
| 2,870,840 | 1/1959 | Kwitek . | |
| 3,039,712 | 6/1962 | Weber et al. | 242/527.3 |
| 3,148,843 | 9/1964 | Turner et al. . | |
| 3,552,670 | 1/1971 | Herman | 242/533.4 X |
| 3,814,342 | 6/1974 | Fujiwara | 242/532.3 X |
| 3,848,824 | 11/1974 | Van Schijndel | 242/527.4 |
| 3,853,279 | 12/1974 | Gerstein | 242/521 |
| 4,153,215 | 5/1979 | Schulze | 242/527.3 |
| 4,171,780 | 10/1979 | Bugnone | 242/527.3 X |
| 4,488,687 | 12/1984 | Andreasson | 242/527.3 |
| 4,541,583 | 9/1985 | Forman et al. | 242/527.3 |
| 4,635,871 | 1/1987 | Johnson et al. . | |
| 4,962,897 | 10/1990 | Bradley . | |
| 4,993,652 | 2/1991 | Moeller | 242/527.3 |
| 5,520,352 | 5/1996 | Prix et al. | 242/527.3 |

FOREIGN PATENT DOCUMENTS

| | | |
|---|---|---|
| 0199285 | 10/1986 | European Pat. Off. . |
| 0616965 | 9/1994 | European Pat. Off. . |
| WO94/21545 | 9/1994 | WIPO . |
| WO94/29205 | 12/1994 | WIPO . |

OTHER PUBLICATIONS

Paper Converting Machine Co. v. Magna-Graphics Corp., 680, F.2d 483 (7th Cir. 1982).

Drawing 059887-17-14-00 Dated 22 May 1987 of Paper Converting Machine Company.

*Primary Examiner*—John M. Jillions
*Assistant Examiner*—William A. Rivera
*Attorney, Agent, or Firm*—Tilton, Fallon, Lungmus & Chestnut

[57] ABSTRACT

A method and apparatus for winding an elongate web into a convolutely wound roll either on a core ensleeved on a mandrel or on the mandrel itself and which include providing a center wind rewinder defining an upstream to downstream path having in sequence a web direction changer and a turret indexably rotatable about a first axis and equipped with a plurality of orbiting circumferentially spaced rotatable mandrels. The rewinder has an articulatable arm member indexably rotatable about a second axis outside the orbit of the mandrels. The method includes advancing a web at a predetermined speed in the path from the changer onto a first mandrel and winding the web thereon, moving a second mandrel into confronting relation with the web upstream of the first mandrel while continuing to wind the web on the first mandrel, moving an articulatable part of the arm member into contact with the web to press the web toward the second mandrel, and rotating both the arm member and articulable part to achieve a resultant speed at least as great as the web predetermined speed to sever the web and start winding the web about the second mandrel.

19 Claims, 8 Drawing Sheets

17
18
19
W
W1
W2
W'
30c
32
33
34
35
36
69
47
37
45
39
L'
31
31a
42a
42
L
43
40
29
77
41
44
30
30a
30b 26
135
136
122
123
137
138
190
130
206
149
146
145
141
150
139
131a
142
131
140
151
141
W
191
L
193
192
204
205
140'

METHOD AND APPARATUS FOR CONVOLUTE WINDING

BACKGROUND AND SUMMARY OF INVENTION

This invention relates to a method and apparatus for convolute winding and, more particularly, to the winding into logs or rolls of webs such as bathroom tissue and kitchen toweling.

Still further, the invention is concerned with winding on a mandrel such as is commonly used in center-type winding. In center-type winding, the input speed to the roll being developed is gradually reduced as the diameter increases. This is in contrast to surface winding where the input speed is constant throughout the wind.

For many years, center-type winding was the type described in co-owned Pat. Nos. 2,512,900 and 2,769,600. This type of rewinder was superseded by the rewinder shown and described in co-owned patent Re. 28,353 which was not subject to the 1,000 feet per minute web speed limitation and is still the state of the art for center-type winders. A detailed explanation of these winders can be found in the court opinion reported at 680 F2d 483. A key feature of the reissue patent was the bedroll and cutoff roll.

The invention here provides a simple mechanism which cuts off the web material and transfers it to a new mandrel or core in one motion. It eliminates the costly bedroll and cutoff roll commonly used to transfer the web in center winders. Further, previous mandrel winders equipped with a bedroll were limited to sheet counts on the finished consumer roll to multiples of the bedroll diameter, most commonly, the bedroll circumference was ten sheets of tissue or five sheets of towel. The invention herein provides single sheet count capability with variable length perforation and transfer glue limited to the first revolution of the wind, features previously only available in surface winders. The invention further provides the ability to wind either cored product or coreless product—the latter by equipping the winding mandrels with vacuum as disclosed in related co-owned application Ser. No. 08/373,179 filed Jan. 23, 1995.

More particularly, the invention makes use of an indexable rotatable arm means which rotates about an axis outside of the orbital path of the mandrels. The articulatable part of the arm means is constructed to rotate so that the resultant feed of the part is the same or faster than web speed to sever the web and start winding the web in conjunction with a clamping action on the "new" mandrel, i.e., the mandrel next in line behind the mandrel on which the web is then being wound.

As indicated above, there is nothing like a rotatable arm means for sever and start in the center wind art. An approximation in the surface wind art is the breaker bar of competitor U.S. Pat. No. 3,148,843. This construction, among other deficiencies, was unable to provide exact sheet count. More recently, exact sheet count was provided in surface winders by co-owned U.S. Pat. No. 4,962,897 (also published as EPO 199 285A). This also was true of competitor PCT disclosures 94/21545 and 94/29205. None of these used mandrels and achieved exact count only by employing spaced pinch points—one point being developed by a rotating arm. Other objects and advantages of the invention may be seen in the ensuing specification.

BRIEF DESCRIPTION OF DRAWING

The invention is described in conjunction with the accompanying drawing, in which—

FIGS. 17–19 are developed plan views of the showing in FIG. 2 taken along the sight lines 17—17, 18—18 and 19—19, respectively, while

DETAILED DESCRIPTION

Figures 1, 2:
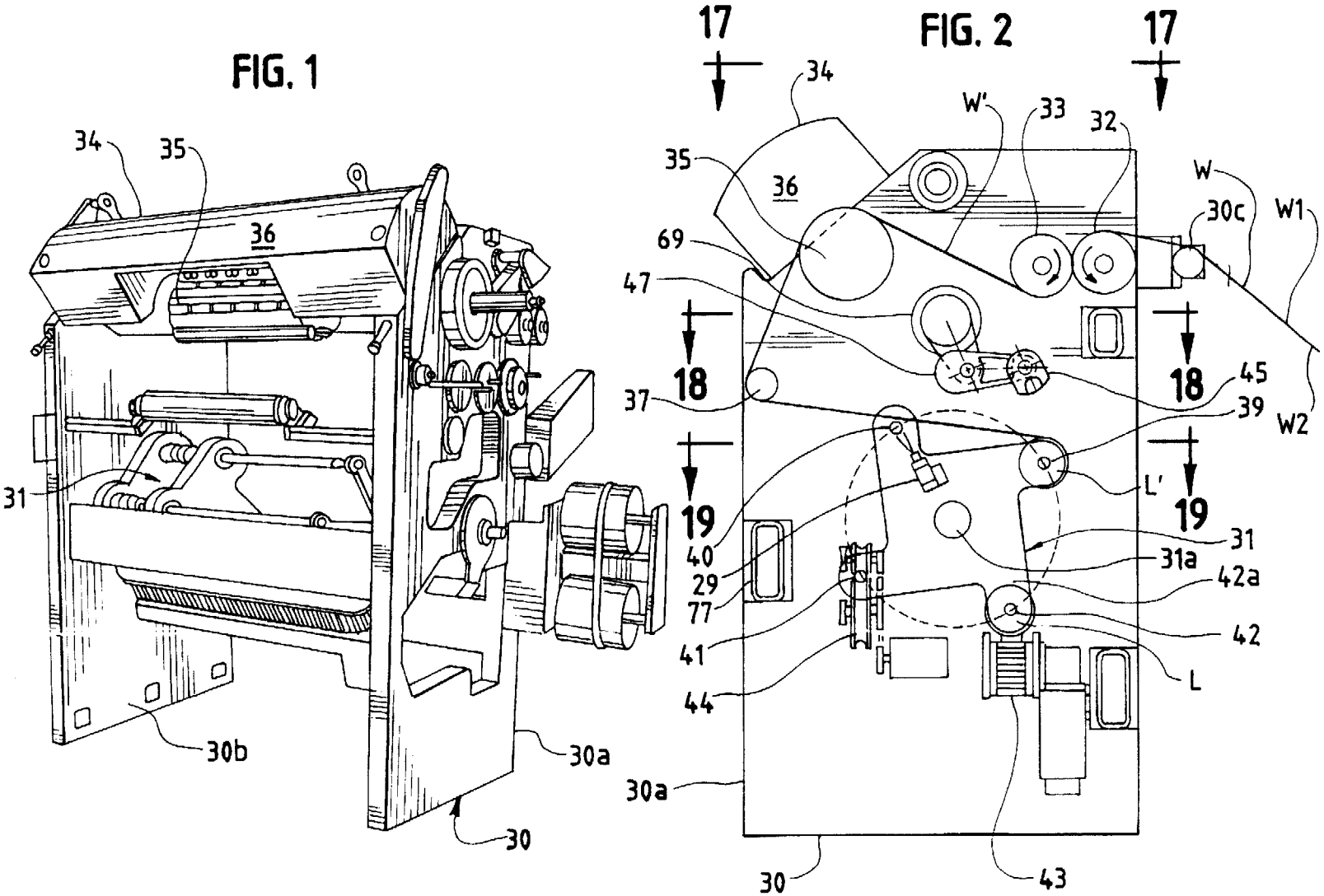
FIG. 1 is a perspective view of a winder embodying teachings of this invention and arranged to wind a web on cores.
FIG. 2 is a side elevational view of the winder seen in FIG. 1 where the turret and indexing arm are in their dwell position during winding.

From FIGS. 1 and 2 it will be seen that the inventive rewinder has a frame generally designated 30 (see FIG. 2) and consisting of sidewalls **30*a* and 30*b* (see FIG. 1). This supports a multi-station turret generally designated 31 for rotation about axis 31*a***.

Now referring to the upper right hand portion of FIG. 2, the entering web is designated W and is normally derived from a parent roll (not shown) of substantial width, viz., 90" on up. The web is advanced toward a path W' by draw rollers 32, 33 and through a perforator generally designated 34. In some instances, the perforator may be omitted and a log or roll produced which has no transverse perforations. However, as illustrated, the perforator 34 includes a blade roller 35 and a bar 36. Illustrative of a widely used perforator is that of co-owned U.S. Pat. No. 2,870,840.

Figures 20, 21, 22, 23, 24, 25, 26:
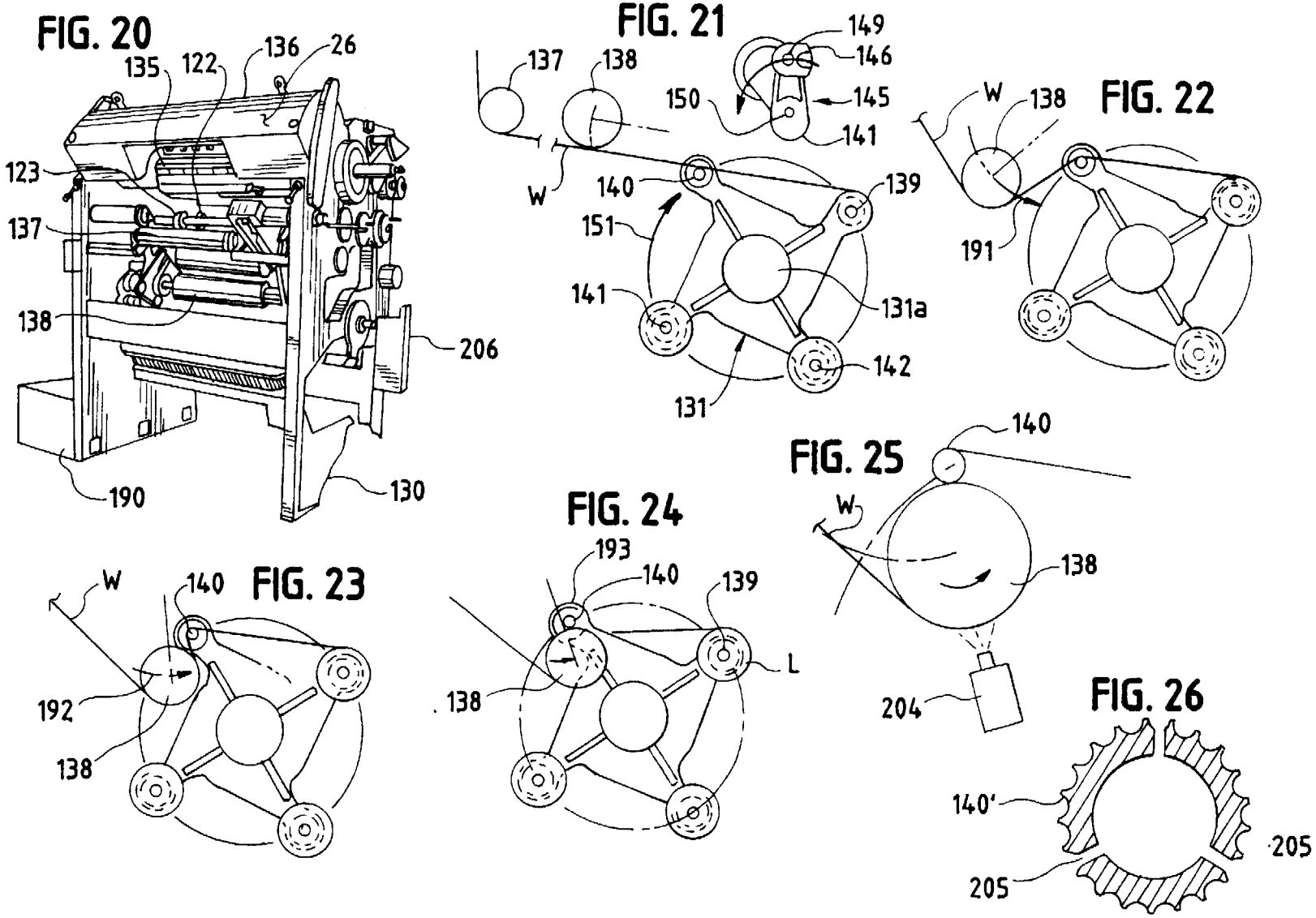
FIG. 20 is a view similar to FIG. 1 but on smaller scale and modified for coreless winding.
FIG. 21 is a fragmentary side elevational view of the apparatus of FIG. 20.
FIGS. 22–24 are sequence views similar to FIG. 21.
FIG. 25 is an enlarged, fragmentary view similar to FIG. 24 but of a modified construction.
FIG. 26 is an enlarged sectional view of the mandrel of FIG. 25.

Thereafter, the web encounters a direction changing means—illustrated in FIGS. 1 and 2 as a stationary idler roller 37. This is eminently suitable for operations with cores but different direction changing means are required for coreless operation—to be described hereinafter with respect to FIGS. 20–26 where there is an enveloping roller 138 as indicated at the left of FIG. 20.

As illustrated in FIGS. 1 and 2, however, the web W after passing around idler 37 is directed into the turret 31 of the center winder. This type of winder has a decreasing mandrel speed characteristic to compensate for log build-up—as contrasted to a surface winder.

As illustrated, the turret 31 has four mandrels 39, 40, 41 and 42. It will be appreciated that a greater or lesser number of mandrels (or stations) may be employed, with the minimum number being two. Such turret constructions are well known—see co-owned U.S. Pat. No. 2,769,600.

The turret 31 is generally spider-like, being equipped with arms (as at 42*a* relative to the mandrel 42 in FIG. 2) for carrying the various mandrels. In FIG. 2, the mandrel 42 has a completely wound log L mounted thereon and the mandrel is in position for stripping the log therefrom by a stripping conveyor 43.

In analogous fashion, the frame 30 is equipped with a core loader 44 which functions to ensleeve a core on a mandrel in the 41 position—here about 8 o'clock.

Lastly, in this brief description of the apparatus, the numeral 45 designates generally the previously mentioned articulatable arm means which cooperates with the mandrels in sequence to provide a novel rewinding operation.

As illustrated in FIG. 2, the turret 31 is equipped with four mandrels starting at 39 where a log L' is in the process of being wound. Then, proceeding counterclockwise, the next mandrel to be wound is designated 40, a still subsequent mandrel to designated 41 and which is in the process of being ensleeved by a core while lastly a still further mandrel is designated 42 and from which the finished log L is being stripped.

FIG. 2

This showing is of the arm means 45 in its stationary position while the log L' is in the process of being wound on the mandrel 39. The arm means 45 includes an articulatable part 46 which functions as a wiping means and can be a pad, brush, wiper, etc. and which is rotatably mounted on the main arm 47. The articulatable part or wiping means 46 continues to rotate at a selected speed, viz., at or above web speed. On the other hand, at that time, the turret 31 is in its dwell position, i.e., not indexing, and the main arm 47 is also not rotating.

The operation of the invention can be better appreciated from a sequence of views showing different stages of the winding operation.

FIG. 3

Figure 3:
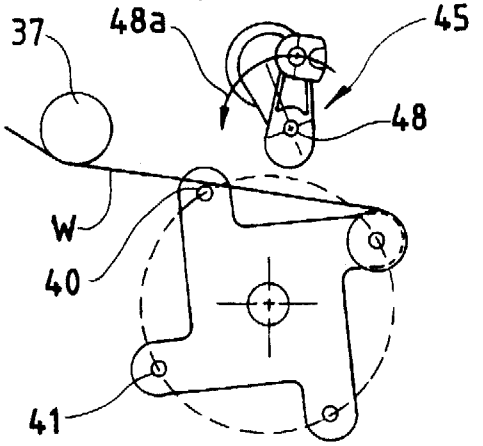
FIG. 3 is a fragmentary enlarged view of the turret and indexing arm seen in the central portion of FIG. 2 and where the indexing arm has started to move toward the next mandrel on which the web is to be wound.

In comparison with FIG. 2 where the articulatable arm means 45 is at about 3 o'clock, the FIG. 3 showing is of the arm means 45 at about 12:30 o'clock. In the illustration given, the arm means 45 rotates counterclockwise about an axis 48 as indicated by the direction arrow 48*a*. Here, the mandrel 40 has been indexed almost into contact with the web W. At this point, the mandrel 40 is ensleeved with a new core and adhesive sprayed onto the core. This is done by spray guns 29 just before transfer. But, by the time the mandrel 40 reaches its FIG. 3 position, it has been accelerated up to web speed.

FIG. 4

Figure 4:
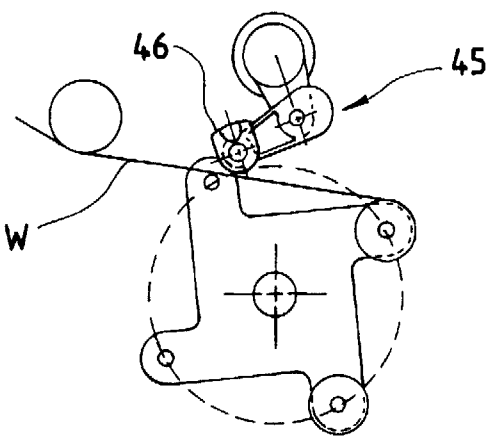
FIGS. 4–12 are views similar to FIG. 3 but showing further steps in the operation of the invention, viz., a series of sequence views.

This view shows the arm means 45 in a more advanced position, i.e., further counterclockwise—say at about 8 o'clock as contrasted to the 12:30 o'clock position in FIG. 3. The arm means 45 is now at full rotational velocity while the wiping means 46 has been rotating continuously at its selected speed. As seen in FIG. 4, the wiping means 46 is approximately one-quarter revolution of its rotation away from contact with the web W and the start of transfer.

FIG. 5

Figure 5:
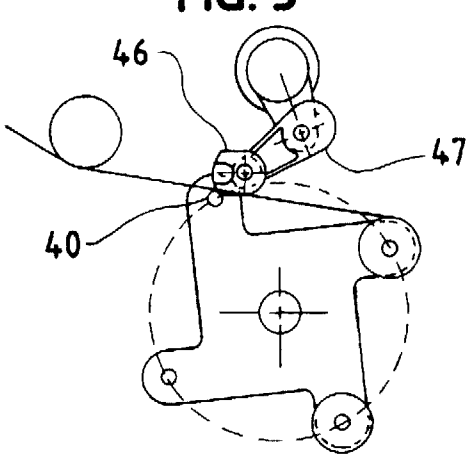

FIG. 5 shows the wiping means 46 as it makes contact with the web W. In the case where the web material is perforated, the leading edge of the wiping means makes contact near the perforation where cut-off is desired. Various web conditions and speeds determine precisely where the contact point should be made. On webs which are not perforated, the edge of the wiping means is made sharp, or equipped with teeth to cut the web material as it strikes into it.

The resultant speed of the wiping means 46 can be varied depending upon web characteristics. On low stretch webs, a speed of 10–20% faster than web speed works well, on higher stretch webs, the speed may go up to 50% faster than web speed or more. For most tissue and towel papers, between 20 and 50% faster than web speed works well. At the minimum, the selected speed of the wiping means 46 should be the same as the predetermined web speed. It will be appreciated that the surface speed of the wiping means 46 is the resultant of the combined rotations of the main arm 47 and the means 46 inasmuch as both are rotating counterclockwise. The main arm, in a typical production will rotate at 100 rpm while the web speed is of the order of 3000 fpm and the pad typically would be 3600–4000 fpm.

Still referring to FIG. 5, once the wiping means 46 makes contact with the web (which is supported by the core-equipped mandrel), it quickly depresses the web onto the glued core on the mandrel 40. The sticky glue on the core holds the sheet at web speed while the wiping means 46 moves forward at a faster speed. The result is that the leading edge of the wiping means pulls the web forward, ahead of the perforation, while the glue holds the other side of the perforation with the glue at web speed—the core surface speed being web speed at transfer. After a short distance of travel of the wiping means, the web material is elongated at the perforation, and the perforation breaks. Thus, the invention isolates the tension required to break the web to a very small part of the web. This is desirable to protect the embossments and web bulk added to many web materials.

Even where there is substantial identity between the web speed and the resultant surface speed of the wiping means 46, the geometry of the means 46 and mandrel 40 provides an additional tension in the web about a line of transverse perforation—or even a line of potential severance, as where no perforation has been provided. This can be appreciated from the distortion of the web W at the point $W_O$ in FIG. 14.

FIGS. 6–10

These views show the wiping means assembly 41 continuing on its wiping the web material onto the new core. Since the wiping means 46 is running the same or faster than the web W, the leading edge and a good part of the first revolution is "wiped" onto the glued core providing a neat, wrinkle-free transfer.

Figure 6:
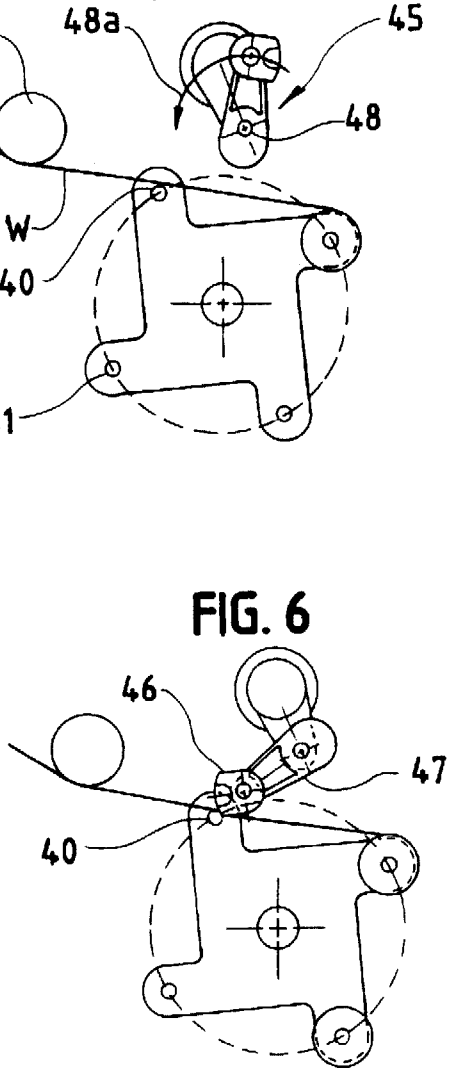
Figure 7:
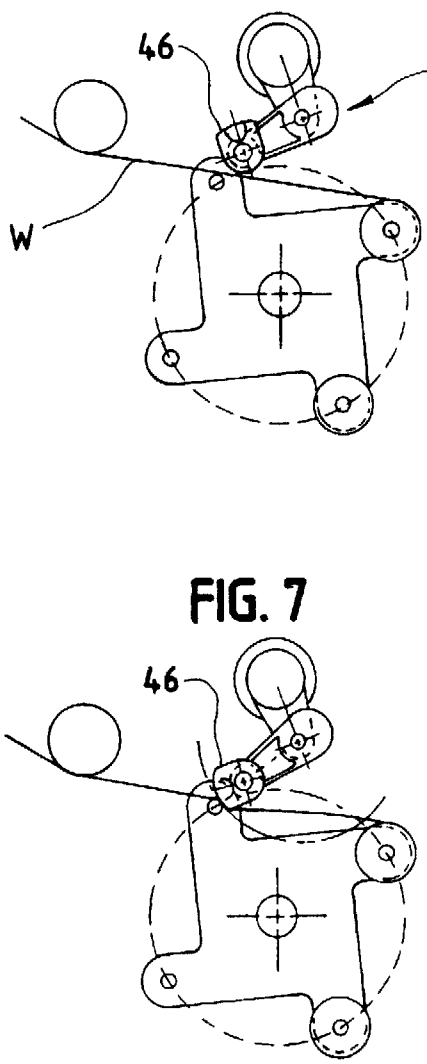
Figure 8:
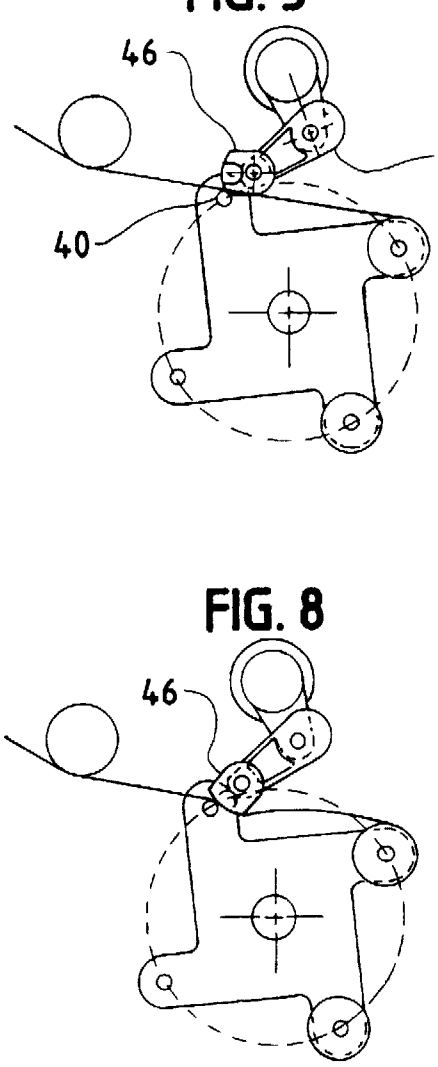
Figure 10:
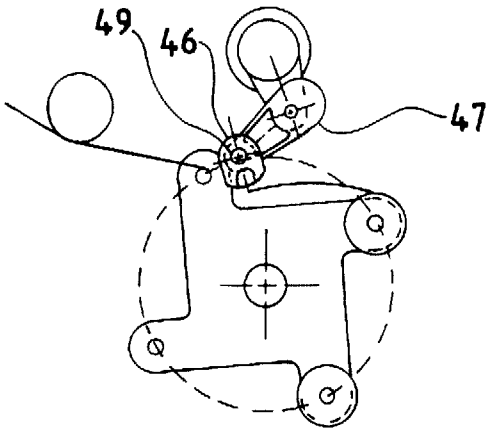

Comparing FIG. 10 with FIG. 6 reveals that there has been relatively little rotation of the main arm 47 (the arm in both showings being at about the 8 o'clock position) but where there has been considerable rotation of the wiping means 46. In FIG. 6, the wiping means is at almost a 9 o'clock position but by the time FIG. 10 has been reached, the counterclockwise rotation of the wiping means 46 brings its contacting edge to about a 5:30 o'clock position.

FIG. 11

Figure 12:
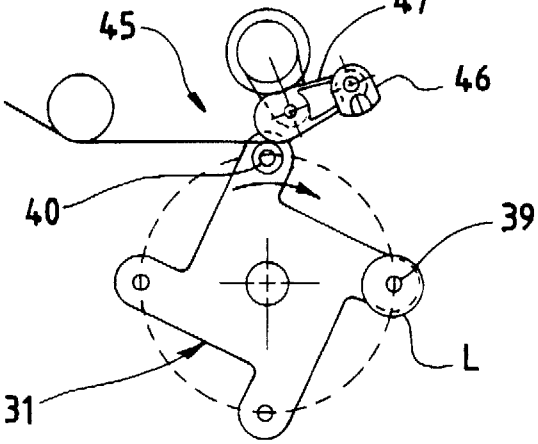
Figure 11:
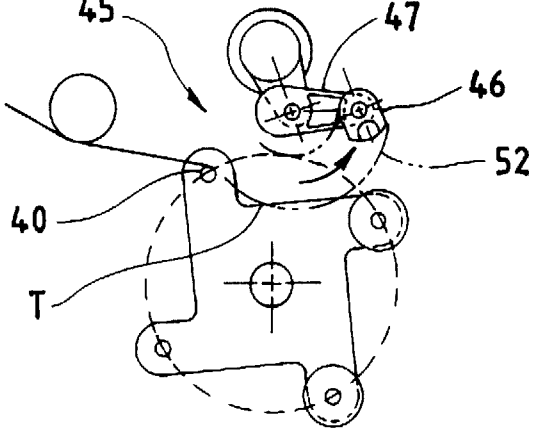

In FIG. 11, it is seen that both the arm 47 and the wiping means 46 have continued their rotation on route to the position depicted in FIG. 12. FIG. 11 shows the arm means 45 nearing the end of its index and coming to a stop—compare with FIG. 2. The newly transferred web is now winding on the new mandrel 40 as the finished wound log L begins to decelerate to a stop for ultimate removal from the mandrel 39.

FIG. 12

FIG. 12 shows the turret 31 beginning to index so that the finished wound log L can be removed, a new core loaded and a freshly loaded core glued and accelerated to speed for the next transfer. Meanwhile, the arm 47 has reached its dwell state—compare the showings of FIGS. 11, 12 and 2. But the wiper means keeps rotating as can be appreciated from a comparison of FIGS. 10 and 11. In FIG. 10, the wiper means 46 is ahead of the arm 47 while in FIG. 11 it is behind the arm 47.

FIG. 13

Figure 9:
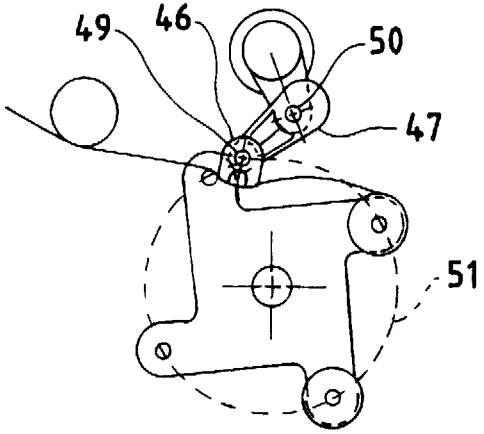

This view shows how the wiping means comes into contact with the web just slightly downstream of the perforation P. Here the term "downstream" is used in the context of the web travel direction—starting in the frame 30 at the upstream end with the spreader roller 30*c* (see the right hand ends of FIGS. 2 and 17). The wiping means 46 rotates about an axis of rotation 49 which is carried at the free end of the arm 47—see FIG. 10. The other, or fixed end, of arm 47 is mounted for rotation about an axis 50—see FIG. 9. This axis 50 is clearly outside the orbital path of the mandrels—designated 51 in FIG. 9. However, the wiping means 46 does protrude into the inside of the orbit as can be appreciated from the curved dashed-line path 52 in FIG. 11.

Returning to FIG. 13, it will be seen that the embodiment illustrated has a thin, curved pad 53 advantageously constructed of velcro, closed cell foam rubber or other resilient deformable material. A nylon brush can be used to advantage by using a pad or wiper no more less than about ¼ from which in thickness, two benefits are realized. First, there is the ability to conform to the core/mandrel cylindrical surface and second, the relative thinness permits the more rigid backing material of the supporting elements 54 to exert a pressure against the web and core, thereby achieving a secure glue bond. The elements 54 are spaced along the width of the rewinder—as can be seen in the central part of FIG. 18. In FIGS. 13–16, it is seen that the elements 54 have notches or cutouts as at 54*a* in FIG. 16 to lighten the loading.

FIG. 14

Figure 14:
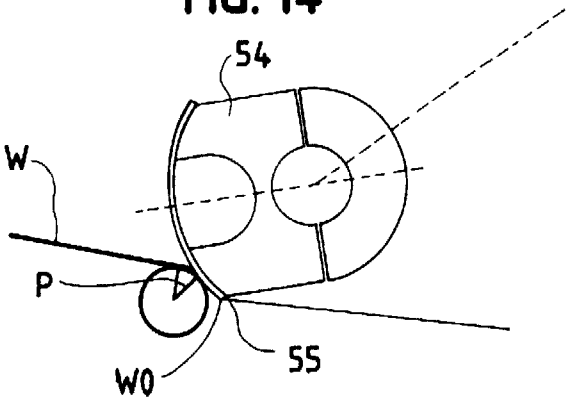
Figure 13:
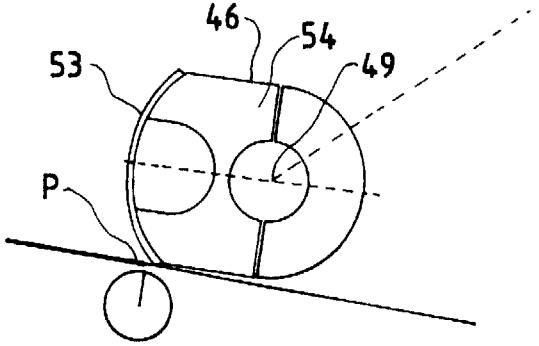
FIG. 13 is a fragmentary enlarged view of the mandrel and wiping means provided on the indexing arm at the beginning of the sever and start operation.
Figure 16:
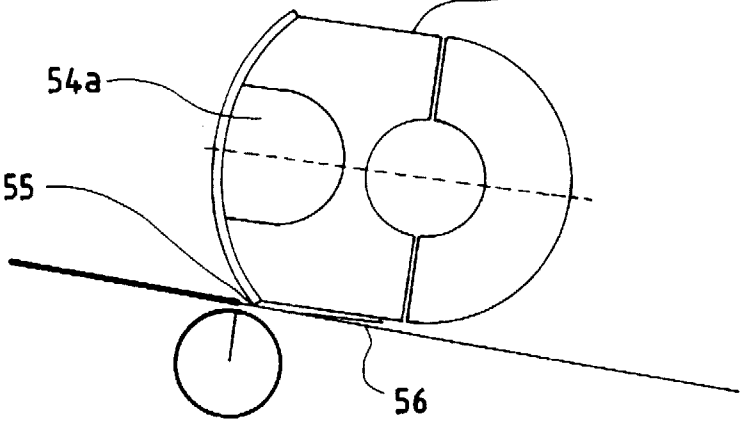
FIG. 16 is an enlarged view similar to FIG. 13 but showing an advantageous friction strip feature.

As indicated previously, there is a deformation of the web W as at $W_0$ in FIG. 14. Especially important in achieving this is the corner 55 of the supporting element 54 which applies a confined tension to the web. Normally, the web will have been severed by the time the showing in FIG. 14 is reached—as can be appreciated from the fact that the perforation P is now at about 1 o'clock compared to the 12 o'clock position in FIG. 13.

FIG. 15

Figure 15:
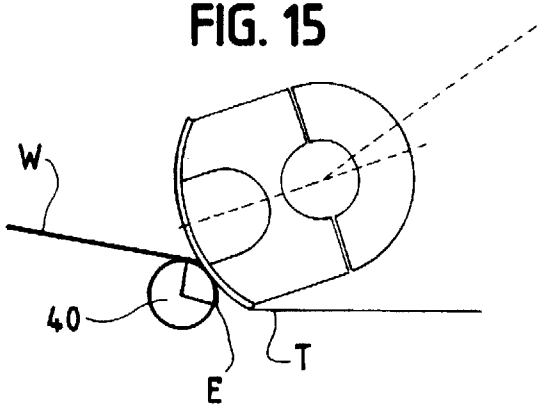
FIGS. 14 and 15 are views similar to FIG. 13 but showing the orientation of the wiping means and mandrel at later stages of the sever and start operation.

The showing in FIG. 15 is just slightly after that of FIG. 14 and it will be seen that the tail T now is definitely separated from the leading edge E of the now-severed web W. Here the mandrel 40 has rotated about 90° from its FIG. 13 position.

FIG. 16

In some instances, it may be advantageous to equip the wiping means 46 with a strip of friction material as at 56 to facilitate the grip of the corner 55 of the wiping means 46 on the web W. Emery cloth, fine sandpaper or a variety of friction surface materials can be used to advantage for this purpose and it is only necessary to have a strip of a width up to about 1" in width—in the direction of web travel. The strip advantageously extends across the width of the rewinder which, as indicated previously, normally operates on webs having transverse dimensions of 90" and up.

FIG. 17

It will be noted that a number of section lines have been applied to FIG. 2 and these are reflected in views 17–19 which deal with various structural details. In summary, the numeral 30*c* at the extreme right in FIG. 17 designates a spreader roller also seen in the extreme right upper portion of FIG. 2. Next, in FIG. 2, the web W encounters the draw rollers 32, 33 and also in FIG. 17 at the right center. Thereafter, the web encounters the perforator 34 (see FIG. 2) which is made up of a bedroll 35 and a bar 36. Lastly, the extreme left showing of FIG. 17 reveals the presence of the web direction changing means in the form of idler roller 37.

Spreader and Draw Rollers

Figure 17:
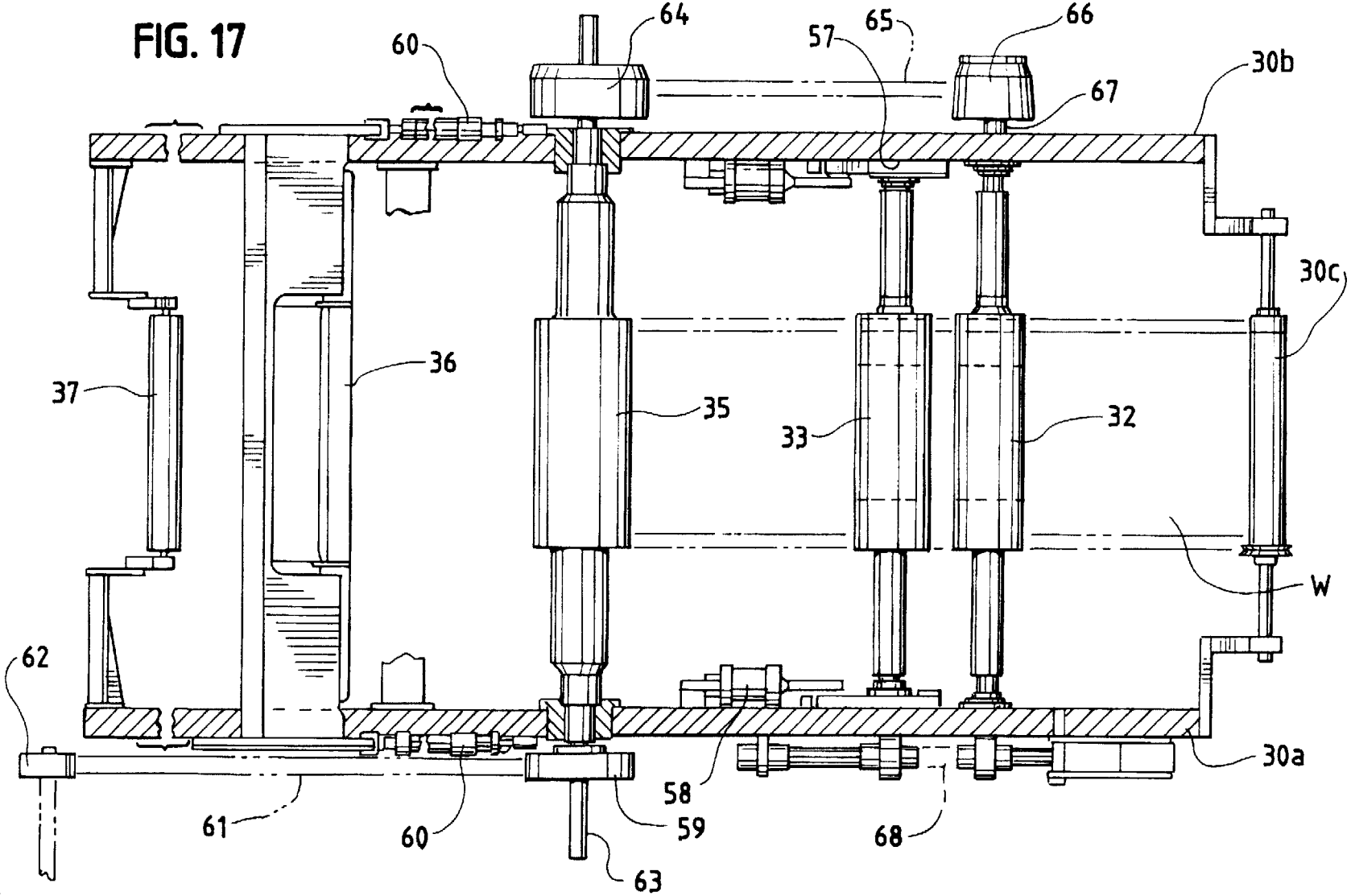

Again, starting at the right of FIG. 17, there is first a spreader roller 30*c* which removes wrinkles before the web W is advanced toward the path W' by draw rollers 32, 33. In the illustration given, the roller 32 is fixed while the roller 33 is pivotably mounted. The numeral 57 designates the two pivot arms and the numeral 58 designates the loading cylinders for the draw roller 33. The draw rollers are driven—from the perforator roll 35. So, before going in to the drive, we first discuss the perforator in connection with FIG. 17.

Perforator

Figure 19:
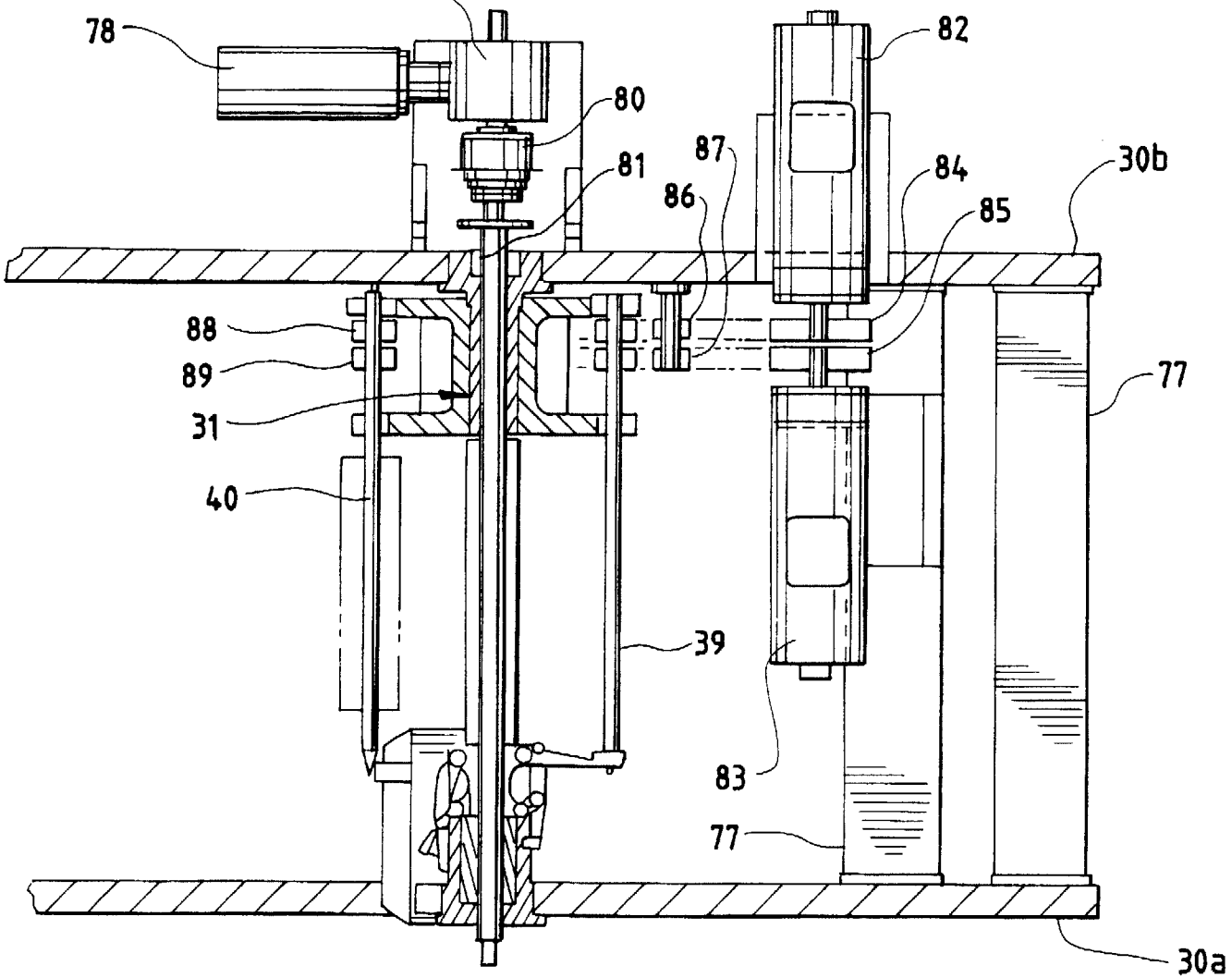

The first operation performed on the web normally is cross perforation as by the perforator 34 which as previously described includes at least one rotating roller 35 operated by a drive pulley 59 or a servo motor similar to 82 in FIG. 19 if variable perf length is desired. The engagement of the web with the perforator 35 results in providing the web with equally longitudinally spaced lines of transverse perforation. The knife bar 36 is equipped with lift cylinders 60.

Drive

The timing belt pulley 59 is coupled by a cog belt 61 (see the lower left portion of FIG. 17) to the rewinder main drive input pulley 62.

As illustrated, one end of the perforator roller shaft 63 is equipped with pulley 59 while the other end has a pulley 64. This is connected via belt 65 to a variable speed drive 66 which, in turn, is connected to the shaft 67 of the fixed draw roll 32. A timing belt drive 68 connects the draw roll 32 with the draw roll 33. Last in proceeding to the left in FIG. 17 is the idler roller 37. For the next level of structure, please refer to FIG. 18.

FIG. 18

Figure 18:
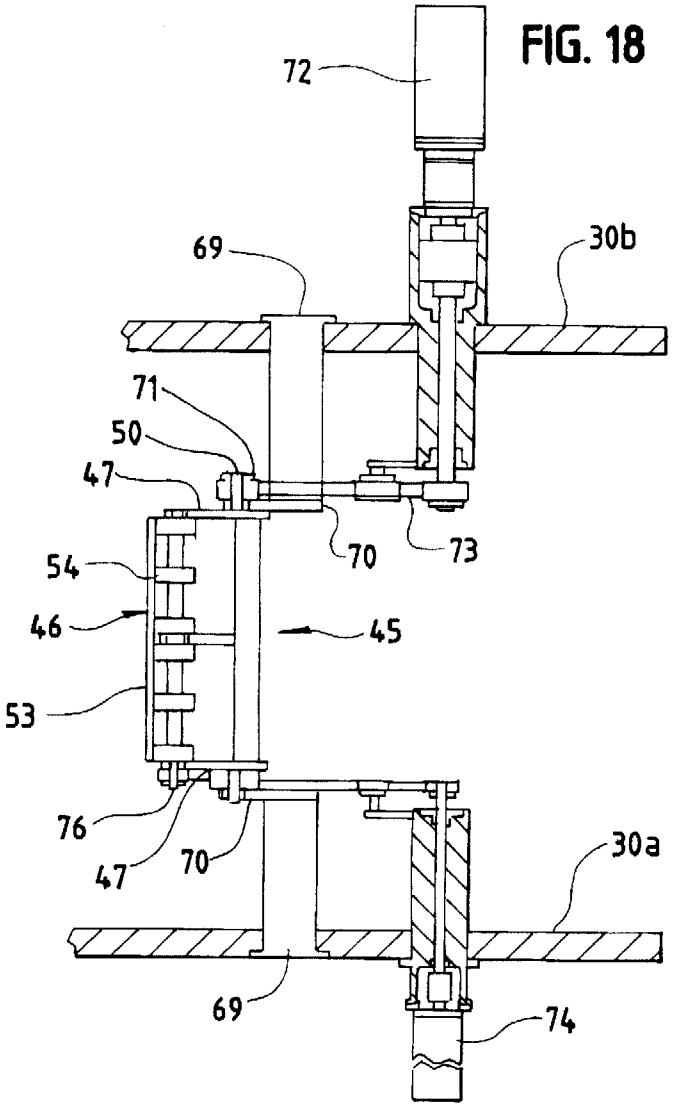

At the central left in FIG. 18 the articulatable arm means 45 which is located above the turret 31 seen in FIG. 19.

Referring again to FIG. 18, the details of the mounting of the arm means 45 can be seen. A pair of brackets 69 are mounted on the frames 30*a*, 30*b* and support the arm means 45—as also can be appreciated from the showing in the upper central part of FIG. 2. Each bracket 69 carries a stationary stub 70 to provide an axis 50 for the main arm 47 in the form of a stub shaft 71. Coupled to the stub shaft 71 is a servo motor 72. A suitable belt drive 73 connects the output of the servo motor 72 to the shaft 71 so as to rotate the arm means 45.

A similar servo motor 74 is provided on the opposite frame 30*a* for rotating the articulatable part or wiping means 46. As seen in FIG. 18, there is a drive connection 75 from the output of the servo motor 74 to the shaft 76 which carries the wiper means 46.

FIG. 19

The lowest level in FIG. 2 contains the turret, mandrels and drives. Again, the frames are designated 30*a* and 30*b* and these are also seen in FIG. 19.

Turret and Mandrels

Especially seen in FIG. 19 is the turret 31 and the mandrels 39, 40. The turret 31 is rotatably mounted in the side frames 30*a*, 30*b*. These side frames are interconnected by spacers as at 77—see the right side of FIG. 19.

The output of the turret drive motor 78 is delivered to a right angle gear box 79 and a clutch 80. The output of clutch 80 is a shaft 81 which is keyed or otherwise fixed to the spider-like turret 31.

A pair of motors 82, 83 are provided for driving the mandrels. In the illustration given, the motor 82 drives the even numbered mandrels, viz., 40 and 42 of FIG. 2 while the motor 83 drives the odd numbered mandrels 39, 41. Each motor output shaft is connected to a drive as at 84, 85 that is entrained over idlers 86, 87 and then over mandrel pulleys 88, 89. Depending upon whether the mandrel is even or odd, one pulley 88, 89 is keyed to a first mandrel while the other 89, 88 is rotatably mounted on the second mandrel in question. Each mandrel advantageously is of the core lock type as seen in co-owned U.S. Pat. No. 4,635,871.

Coreless Operation

Two features are added to the rewinder of FIGS. 1–19 to provide coreless operation. The first is to provide vacuum type mandrels (of the type depicted in co-owned European application 616965) and the second is to provide an enveloping roller as at 138 in FIGS. 18A and 20. First, I describe the operation with the enveloping roller 138 as seen in FIGS. 21–24. Here, the numerals for elements similar to those of the "core" embodiment are the same but increased by 100. Thus, in FIG. 21, the turret is 131 and the mandrels starting from the one being wound are, respectively, 139, 140, 141 and 142. Again, the web W passes around an idler roller—here designated 137. The web then passes around the enveloping roller 138 which, in this embodiment, also performs a direction changing function for the web. The function of the roller 138 is described in greater detail in the above-identified application Ser. No. 08/373,179 where it is also described as an enveloping roller. Briefly, the roller 138 pivots in a counterclockwise fashion as can be appreciated from the sequence of views FIGS. 21–24 so as to cause the web W to wrap the mandrel 40. After that, the articulatable arm means 145 bears against the web to anchor the web to itself. The roller 138 in its enveloping mode is used advantageously for coreless product where the web is attached to the mandrel with vacuum and the enveloping assists the vacuum to hold the web. When running cores with glue, the roller 138 may either be omitted or remain stationary and out of the web path.

FIG. 20

As mentioned previously, this view is similar to FIG. 1 but of a rewinder especially adapted for coreless rewinding. As before, the rewinder includes a frame 130, perforator roller 135, knife bar 136 following draw rollers 122 and 123. Featured prominently is the enveloping roller 138 and a box 190 housing the controls, compressor, etc. to provide vacuum in the mandrels.

FIG. 21 Showing

The first mandrel 139 is the mandrel being wound with the web W. The next mandrel 140 is seen approaching a position of contact with the web W s the turret 121 rotates clockwise. The mandrel 140 is now being accelerated to web speed. The enveloping roller 138 has been pivoted to a substantial distance away from the mandrel 140.

FIG. 22 Showing

Here it will be noted that the enveloping roller 138 has started to pivot counterclockwise (see arrow 191) from its position in FIG. 21 to become partially enveloped by the web and also develop a partial enveloping relation of the web with the mandrel 140. The web W, however is still being wound on mandrel 139. Because the winding of the log is nearing completion, the actuatable arm means 145 starts to move toward the mandrel 140. This has been omitted from FIG. 22 but its position and orientation would be that of the arm means 45 between FIGS. 3 and 4—as do the showings in FIGS. 23 and 24.

FIG. 23 Showing

Here the mandrel 140 is seen to be further wrapped by the web W because the enveloping roller 138 has moved further counterclockwise from its position in FIG. 22—see the arrow 192.

FIG. 24 Showing

The situation at cutoff and transfer is illustrated in FIG. 24 where a log L is almost completely wound on the mandrel 139. The mandrel 140 is now backed by the enveloping roller 138. The enveloping roller 138 has pivoted to its furthest counterclockwise position along the path designated by the arrow 193 and mandrel 140 is ready for engagement by the arm means 145—as in FIG. 6. The operational sequence for coreless production is thereafter the same as with cores, viz., like FIGS. 7–12.

Enveloping Roller Details

Figure 18A:
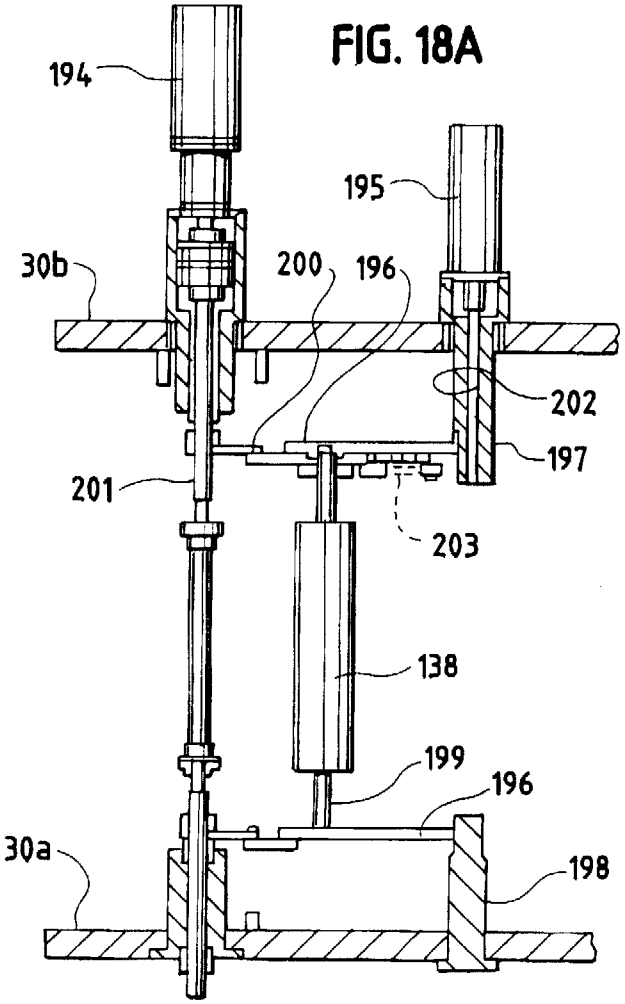
FIG. 18A is a developed plan view of additional elements used when the rewinder is producing coreless products.

The only roller in FIG. 18A is the enveloping roller 138 which is pivotally, rotatably mounted on the side frames 30*a*, 30*b*. Two servo motors are provided for this dual movement. A servo motor 194 controls the pivotal position of the enveloping roller 138 while servo motor 195 controls the rotational speed of the enveloping roller 138.

For pivoting the enveloping roller 138, a pair of pivot arms 196 are journaled at one end on members 197, 198. Adjacent their other ends, the arms 196 rotatably carry the shaft 199 of the enveloping roller 138. At the ends near the connection of the shaft 199, the arms 196 are coupled to a pivot linkage 200 fixed to a transverse shaft 201 driven by the servo motor 194. This provides for pivoting the enveloping roller 138 from a first position (FIG. 21) where the web is out of contact with the enveloping roller 138 to a second position (FIG. 24) where the web W is wrapped about both the enveloping roller and the mandrel 22.

For rotating the enveloping roller 138, the servo motor 195 is equipped with an output shaft 202 which extends through the member 197. The inner end of shaft 202 is coupled by a belt drive 203 to the shaft 199 of the enveloping roller 138.

FIG. 25

This view illustrates a typical mandrel 140 which is equipped with vacuum passages to retain the web W against the mandrel periphery as it is being wrapped on the mandrel by the enveloping roller 138. Where it is desirable in the final roll product to keep the central opening from collapsing, transfer agents such as starch or a laminating adhesive can be applied by the nozzle means 204. This results in ply bonding of the initially wound layers of web material.

FIG. 26

This view illustrates a fluted mandrel as at 140'. The fluted or spline version is advantageous where the mandrel diameter is so small as not to effectively accommodate adequate vacuum passages for machines of the order of 100" in width. Normally, mandrels of about a 1 to 1½" (25–37 mm.) diameter can accommodate the vacuum passages and ports 205. The vacuum passages and ports 205 assist in effecting transfer, i.e., holding the severed web against the "new" mandrels. The fluted mandrels assist in transfer by immobilizing the web on the mandrel surface.

The mandrels with smooth surfaces are advantageously teflon-coated. The mandrel vacuum is effective to keep the web material on the mandrel. The vacuum keeps the transfer uniform and reduces wrinkling of the web which can cause high tension points. Advantageously, the ports may have countersunk openings facing the web W so as to improve holding strength and permit a lower vacuum.

As an example of the practice of the invention utilizing full diameter rollers but with narrow width (600 mm, 24 inches), a mandrel with flutes and vacuum permits web speeds up to about 2500 feet per minute (770 meters per minute).

Controller

The numeral 206 in FIG. 20 designates a controller which controls the operation of the various rollers and, especially the pivoting and rotation thereof, i.e., the various motors described in conjunction with FIGS. 17–19. For example, the speed of the enveloping roller 138 along with the mandrel speed is controlled to compensate for the changing web length from the perforator to the log being wound when the enveloping roller 138 and turret 131 change position—compare FIGS. 21 thorough 24. More particularly, as the web path changes by the change of the enveloping roller position, the mandrel 139 speeds up or slows down to correct for the change without changing tension. Some tension change could be permitted depending on the percent of stretch available in the web material. It is advantageous to change the enveloping roller rotational position (speed) along with that of the mandrels to compensate for the web length change.

The position of the enveloping roller 138 is programmed as a function of the product. The program calculates the change in web length as a result of the changed enveloping roller position, and changes the programmed speed of the mandrels accordingly. A suitable controller for the inventive rewinder is Model PIC 900 obtainable from Giddings and Lewis located in Fon-du-Lac, Wis.

SUMMARY

In general, the inventive method is concerned with winding an elongate web having first side $W_1$ and a second side $W_2$ into a convolutely wound roll or log L (see FIG. 2 at the lower right). The method steps include:

(a) providing a center wind rewinder 30, 130 defining an upstream to downstream path W' having in sequence web direction changing means 37, 137–138 and a turret 31, 131 indexably rotatable about a first axis 31*a*, 131*a* and equipped with a plurality of orbiting, circumferentially spaced rotatable mandrels 39–42, 139–142, the winder also having articulatable arm means 45, 145 indexably rotatable about a second axis 50, 150 (see FIGS. 9 and 21) outside the orbit 51, 151 of the mandrels, (b) advancing a web W at a predetermined speed in the path from the web direction changing means onto a first mandrel 39, 139 on the turret 31, 131 and winding the web on the first mandrel, (c) moving a second mandrel 40 into confronting relation with the web first side $W_1$ upstream of the first mandrel 40 while continuing to wind the web on the first mandrel, (d) moving an articulatable part 46, 146 of the arm means 45, 145 into contact with the web second side $W_2$ to press the web toward the second mandrel, and (e) rotating both the arm means main arm 47, 147 and articulatable part 46, 146 to provide a resultant speed of the surface of the part 46, 146 at least as great as the web predetermined speed to sever the web and start winding the web about the second mandrel.

More particularly, the inventive method has steps which include equipping the articulatable part 46, 146 with wiping means 53 to sever the web and substantially simultaneously therewith press the leading edge of the severed web toward the second mandrel.

When the invention is practiced in the "core" winding mode, the embodiment of FIGS. 1–19 is employed. Here, the web direction changing means is the stationary direction roller 37—see FIG. 2.

In such case, I provide means 44 for ensleeving a core on the second mandrel 40 prior to moving the second mandrel into confronting relation with the web first side $W_1$, and a means 29 for glue application to the core.

The inventive method steps also include rotating the articulatable part 46 at a surface speed (resulting from the combined rotation of parts 46 and 47) of about 10% to about 50% faster than the web speed and in the case of advancing either a towel or tissue web, the articulatable part speed is above about 20% faster than the web speed.

When the inventive method is practiced in coreless winding, I provide an enveloping roller 138 as part of the web direction changing means move the enveloping roller in a generally arcuate direction partway around the second mandrel 40 to form a generally S-shaped configuration in the web path about the enveloping roller and the second mandrel while the web is being wound on the first mandrel whereby the web partially wraps the second mandrel. I also provide means for retaining the leading edge of the severed web in a position relative to the mandrel 40—this by providing each mandrel with vacuum means in the form of ports 205—see FIG. 26.

The switch-over from the "core" winding mode to the "coreless" mode is simple and quick. The only mechanical work required normally is to replace the core lock mandrels 39, 40, etc. with vacuum mandrels 139, 140, etc. This takes about 15 minutes because both types of mandrels are mounted in the same bearings. On the other hand, the enveloping roller 138 is a permanent feature and only has to be actuated to move from its dwell position above the web as seen in FIG. 21.

The switch-over, in more detail, provides for the cyclic winding of an elongate web into convolutely wound rolls in either a core or coreless winding mode by the following:

(a) providing a center wind rewinder defining an upstream to downstream path having in sequence (i) web direction changing means 37, 137, 138 and (ii) a turret indexably rotatable about a first axis and equipped with a plurality of orbiting, circumferentially spaced rotatable mandrels, the rewinder also having means for ensleeving cores cyclically on said mandrels, the rewinder also having arm means indexably rotatable about a second axis outside the orbit of the mandrels for pressing the web toward a given mandrel to be wound with the web so as to sever the web and start winding a new convolutely wound roll on the given mandrel, (b) operating the rewinder in the core winding mode to wind the web upon a first mandrel including operating the ensleeving means once each cycle of winding and while maintaining stationary the web direction changing means, (c) moving a second mandrel (i.e., the "given" mandrel) equipped with a core into confronting relation with the web upstream of the first mandrel while continuing to wind the web on said first mandrel, (d) after completing the winding of a roll or log on the second mandrel, stopping the core ensleeving means and pivoting the web direction changing means once each cycle to partially wrap the second mandrel, and (e) thereafter each cycle moving the arm means into contact with the web to press the web against the second mandrel for operating the rewinder in a coreless winding mode.

More particularly, this cyclic winding in the coreless mode involves providing mandrels equipped with vacuum passage and port means, and applying vacuum to the second mandrel during pivoting of the web direction changing means. It also includes substituting the vacuum-type mandrels during switch-over.

The apparatus for convolutely winding a web includes a frame 30, 130, a turret 31, 131 mounted on the frame and equipped with a plurality equally circumferential spaced apart mandrels 39–42, 139–142, means 78 for indexing the turret about a first axis 31*a*, 131*a* and thereby indexably orbiting the mandrels, means 82–87 operatively associated with the turret for selectively rotating each of the mandrels, means 32, 33 on the frame for feeding at a predetermined speed a web to the turret for engagement sequentially with each of the mandrels, and a sever an start mechanism 45, 145 mounted on the frame for sequential coaction with the mandrels, the mechanism including: an articulatable arm means having first 46 and second 47 ends with the first end 47 mounted on the frame for rotation about a second axis 50 outside the orbit or the mandrels, the arm means at its second end being equipped with a rotatably mounted articulatable part 46 engageable with a web on a mandrel, means on the frame for rotating the arm means for each mandrel index, and means operably associated with the articulatable arm means and articulatable part for simultaneously rotating the articulatable arm means and the articulatable part to provide a resultant speed of the part at least as great as the web predetermined speed with the articulatable part including means 53 for wiping the web to press the web toward a mandrel.

While in the foregoing specification a detailed description of the invention has been set down for the purpose of illustration, many variations in the details hereingiven may be made by those skilled in the art without departing from the spirit and scope of the invention.

I claim:

1. In a method for winding an elongate web having first and second sides into a convolutely wound roll, the steps of providing a center wind rewinder defining an upstream to downstream path having in sequence web direction changing means and a turret indexably rotatable about a first axis and equipped with a plurality of orbiting, circumferentially spaced rotatable mandrels, said rewinder also having articulatable arm means indexably rotatable about a second axis outside the orbit of said mandrels, advancing a web at a predetermined speed in said path from said web direction changing means onto a first mandrel on said turret and winding said web on said first mandrel, moving a second mandrel into confronting relation with said web first side upstream of said first mandrel while continuing to wind said web on said first mandrel, moving an articulatable part of said arm means into contact with said web second side to press said web toward said second mandrel, and rotating each of said articulatable arm means and the articulatable part thereof through 360° so that the resultant speed of the articulatable part is at least as great as said web predetermined speed so as to sever said web and start winding said web about said second mandrel.

2. The method of claim 1 in which said steps include equipping said articulatable part with wiping means to sever said web and substantially simultaneously therewith press the leading edge of the severed web toward said second mandrel.

3. The method of claim 2 in which said steps include rotating said arm means and articulatable part so that the resultant surface speed of said articulatable part is about 10% to about 50% faster than said web speed.

4. The method of claim 1 in which said steps include advancing either a towel or tissue web and rotating said arm means and said articulatable part so that the resultant surface speed of said articulatable part is above about 20% faster than said web speed.

5. The method of claim 4 in which said steps include providing a stationary roller in said web direction changing means.

6. The method of claim 1 in which said steps include providing means for ensleeving a core on said second mandrel prior to moving said second mandrel into confronting relation with said web first side.

7. The method of claim 1 in which said steps include providing an enveloping roller in said web direction changing means and moving said enveloping roller in a generally arcuate direction partway around said second mandrel to form a generally S-shaped configuration in said web path about said enveloping roller and said second mandrel while said web is being wound on said first mandrel whereby said web partially wraps said second mandrel.

8. The method of claim 7 in which said steps include providing means for retaining the leading edge of the severed web in a position relative to said mandrel.

9. The method of claim 8 in which said step of providing said retaining means includes equipping each mandrel with vacuum applying means.

10. The method of claim 9 in which said steps include applying a stabilizer material to said web in a position spaced from the leading edge of said severed web.

11. The method of claim 1 in which said steps include providing a perforator upstream of said turret, cross perforating said web at equally longitudinally spaced lines, and operating said articulatable part to sever said web along a predetermined line of cross perforation.

12. Apparatus for convolutely winding a web comprising a frame, a turret mounted on said frame and equipped with a plurality of equally circumferential spaced apart mandrels, means for indexing said turret about a first axis and thereby indexably orbiting said mandrels, means coupled to said turret for selectively rotating each of said mandrels, means on said frame for feeding at a predetermined speed a web to said turret for engagement sequentially with each of said mandrels, and a sever and start mechanism mounted on said frame for sequential coaction with said mandrels, said mechanism including:

an articulatable arm means having first and second ends with said first end mounted on said frame for rotation about a second axis outside the orbit of said mandrels, said arm means at its second end being equipped with a rotatably mounted articulatable part engageable with a web on a mandrel, means on said frame for rotating each of said arm means and said articulatable part through 360° for each mandrel index, and means coupled to said articulatable arm means and articulatable part for simultaneously rotating said articulatable arm means and said articulatable part to provide a resultant speed of said part at least as great as said web predetermined speed.

13. The apparatus of claim 12 in which said articulatable part includes means for wiping said web to press said web toward one of said mandrels.

14. The apparatus of claim 12 in which said frame defines an upstream to downstream path having in sequence in said path a web direction changing means and said turret.

15. The apparatus of claim 14 in which said web direction changing means includes a stationary idler roller.

16. The apparatus of claim 14 in which said web changing means includes an enveloping roller, means on said frame for moving said enveloping roller in a generally arcuate direction partway around a mandrel to be wound to form a generally S-shaped configuration in said web path about said enveloping roller and the aforesaid mandrel.

17. The apparatus of claim 16 in which said mandrels are equipped with vacuum passage and port means for holding said web against said mandrels.

18. The apparatus of claim 12 in which a perforator is mounted on said frame to cross perforate said web prior to web engagement with a mandrel.

19. In a method for winding an elongate web having first and second sides into a convolutely wound roll, the steps of providing a center wind rewinder defining an upstream to downstream path having in sequence a perforator, web direction changing means, and a turret indexably rotatable about a first axis and equipped with a plurality of orbiting, circumferentially spaced rotatable mandrels, said rewinder also having articulatable arm means indexably rotatable about a second axis outside the orbit of said mandrels, advancing a web at a predetermined speed in said path from said web direction changing means onto a first mandrel on said turret and winding said web on said first mandrel, moving a second mandrel into confronting relation with said web first side upstream of said first mandrel while continuing to wind said web on said first mandrel, moving an articulatable part of said arm means into contact with said web second side to press said web toward said second mandrel, and rotating each of said articulatable arm means and the articulatable part thereof through 360° so that the resultant speed of the articulatable part is at least as great as said web predetermined speed so as to sever said web and start winding said web about said second mandrel.

* * * * *